US007009584B2

(12) United States Patent
Kim

(10) Patent No.: US 7,009,584 B2
(45) Date of Patent: Mar. 7, 2006

(54) METHOD OF DRIVING A PLASMA DISPLAY PANEL

(75) Inventor: Jung Hun Kim, Seoul (KR)

(73) Assignee: LG Electronics, Inc., Seoul (KR)

( * ) Notice: Subject to any disclaimer, the term of this patent is extended or adjusted under 35 U.S.C. 154(b) by 349 days.

(21) Appl. No.: 10/219,659

(22) Filed: Aug. 16, 2002

(65) Prior Publication Data

US 2003/0034937 A1 Feb. 20, 2003

(30) Foreign Application Priority Data

Aug. 17, 2001 (KR) ..... 2001-49681

(51) Int. Cl.
*G09G 3/28* (2006.01)

(52) U.S. Cl. ..... 345/60; 345/62; 345/68

(58) Field of Classification Search ..... 345/60, 345/62, 67, 68, 169.1, 169.4
See application file for complete search history.

(56) References Cited

U.S. PATENT DOCUMENTS 6,489,727 B1 * 12/2002 Kanazawa ..... 315/169.4
6,614,413 B1 * 9/2003 Tokunaga et al. ..... 345/63
6,621,229 B1 * 9/2003 Kanazawa et al. ..... 315/169.3
6,680,717 B1 * 1/2004 Tanaka ..... 345/60

FOREIGN PATENT DOCUMENTS

JP 2000-242224 A 9/2000

OTHER PUBLICATIONS

Abstract of JP 2000-231362.
Abstract of JP 2000-267627.
Abstract of JP 2000-267106.
Abstract of JP 2000-315069.
Abstract of JP 2000-035774.
Abstract of JP 2000-214823.
Abstract of JP 2000-259117.
Abstract of JP 2000-267625.
Abstract of JP 2001-210238.
Abstract of JP 06-012026.
Abstract of JP 2001-117532.
Abstract of JP 2001-022322.
Abstract of JP 2001-166734.

* cited by examiner

*Primary Examiner*—Albert Decady
*Assistant Examiner*—Fritz Alphonse
(74) *Attorney, Agent, or Firm*—Birch, Stewart, Kolasch & Birch, LLP

(57) ABSTRACT

A plasma display panel (PDP), and a method of driving plasma display panel, achieve improved contrast by minimizing quantity of luminescence in a non-luminescent display period, that is, a reset period. A method of driving a PDP having a plurality of discharge cells with a plurality of scanning electrodes, a plurality of sustain electrodes, and a plurality of address electrodes involves forming a frame having a plurality of sub-fields; causing a reset discharge in only first sub-fields of the respective plurality of discharge cells; deciding ON/OFF state of discharge cells in current sub-field in accordance with ON/OFF state of discharge cells in previous sub-field; and converting the discharge cell into any one of ON/OFF wall electric charges in accordance with the ON/OFF state of the decided discharge cell.

15 Claims, 9 Drawing Sheets

METHOD OF DRIVING A PLASMA DISPLAY PANEL

BACKGROUND OF THE INVENTION

1. Field of the Invention

The present invention relates generally to a plasma display panel, and more particularly, to a method of driving a plasma display panel for improving contrast by minimizing the quantity of luminescence during a non-luminescent display period, that is, a reset period.

2. Description of the Prior Art

A plasma display panel (hereinafter, PDP) displays images including characters or graphics by making UV lights of 147 nm, which is produced in a non-active mixed gas discharge of He+Xe or Ne+Xe, hit phosphor and radiate. In this PDP, super thin and light structure is easily achieved, and greatly enhanced image can be provided by recent technology development. Particularly, in three electrodes AC normal radiation type PDP, because wall electric charges are accumulated at a surface in discharge and electrodes are protected from sputtering due to discharge, there is an advantage of low voltage driving and longevity.

FIG. 1 is a perspective view showing a conventional AC normal radiation PDP.

As shown in FIG. 1, a discharge cell of three electrodes AC normal radiation type PDP includes a scanning electrode 12Y and a sustain electrode 12Z formed on an upper substrate, and an address electrode 20X formed on an under substrate.

An upper dielectric layer and a protection layer are formed on the upper substrate which has the scanning electrode 12Y and the sustain electrode 12Z formed in order thereon. Wall electric charges produced in plasma discharge are accumulated in the upper dielectric layer 14. The protection layer 16 not only protects damage of the upper dielectric layer 14 from sputtering in plasma discharge but also improves production efficiency of secondary electron. Conventionally, an MgO is used as the protection layer 16. An under dielectric layer 22 and a barrier rib 24 are formed on the under substrate 18 having the address electrode 20X formed thereon, and a phosphor 26 is applied to surfaces of the under dielectric layer 22 and the barrier rib 24. The address electrode 20X is formed in a direction crossing the direction of the scanning electrode 12Y and the sustain electrode 12Z.

The barrier rib 24 is formed in order with the address electrode 20X, and protects UV lights and visible lights produced in discharge from leakage to adjacent cells. The phosphor 26 is excited by UV lights produced in plasma discharge, and then produces any one visible light of red, green, and blue. Non-active gas is injected into a discharge space between the upper and under electrodes 10, 18 and the barrier rib 24 for gas discharge.

Such discharge cells are arranged in a matrix form, as shown in FIG. 2. As shown in FIG. 2, a discharge cell 1 is formed over an area where a scanning electrodes Y1 and a sustain electrodes Z1 cross an address electrodes X1. A plurality of scanning electrodes Y1, . . . , Ym are drove in sequence, and a plurality of sustain electrodes Z1, . . . , Zm are drove in common. And a plurality of address electrodes X1, . . . , Xn are drove in division of even lines and odd lines.

In the above-described three electrodes AC normal discharge type PDP, it is the basic principle of each cell that first, address discharge is caused in a space between a the scanning electrode 12Y and the address electrode 12X in order to produce wall electric charge therein, second, sustain discharge is caused between the scanning electrode 12Y and the sustain electrode 12Z in order to make discharge gas a plasma, thereby producing an UV lights, and then the UV lights is made to excite phosphor in order to produce visible lights.

Such three electrodes AC normal discharge type PDP is drove in division of a plurality of sub-fields. And, in respective the plurality of sub-field periods, luminescence are produced several times, the number of which is proportional to weighted value of video data, thereby realizing contrast display. For example, in the case of displaying an image in 256 contrasts using 8 bits video data, one frame display time in respective discharge cells (for instance, a sixtieth second=about 16.7 msec) is divided into eight sub-fields SF1, . . . , SF8, as shown in FIG. 3.

Respective sub-fields SF1, . . . , SF8 is divided again into a reset period, an address period, and a sustain period, and then weighted values are allowed to the sustain period at the rate of 1:2:4:8:, . . . , 128. In this case, the reset period is a period for initializing a discharge cell, the address period is a period for causing an alternative address discharge in accordance with the logic value of video data, and the sustain period is a period for sustaining the discharge in the discharge cell where the address discharge is caused. The reset period and the address period are equivalently allowed in respective sub-field periods, but respective sustain periods are allowed at the rate of 1:2:4:8:16:32:64:128.

Therefore, 256 contrasts, each of which is different from 0 to 255, can be realized in one frame by properly selecting ON/OFF sub-fields. For Example, in the case of 1 contrast, only period of first sub-field, that is, period of SF1 is used. And, in the case of 100 contrast, only periods of third, sixth, and seventh sub-fields SF3, SF6, SF7 are used, and in the case of 256 contrast, periods of all sub-fields are used.

FIG. 4 is a diagram showing driving waveform of a conventional PDP in the case of using lamp waveform reset pulse in reset periods of all sub-fields in one frame.

As shown in FIG. 4, a reset pulse RP is applied to a scanning electrode Y in a reset period RPD of all sub-fields SF1, . . . , SF8. The reset pulse RP has a lamp waveform where a voltage increases in Set-up and a voltage decreases in Set-down. Because of reset discharge caused in Set-up, wall electric charges are formed at the upper dielectric layer 14. Then, decreasing voltage in Set-down erase unnecessary charge particles partially, so that wall electric charge decrease to the state for next address discharge without fault discharge.

To decrease the wall electric charge, a positive DC voltage Vs is applied to the sustain electrode Z in Set-down of the reset pulse RP. Because the reset pulse RP is applied in gradual decrease against this positive DC voltage Vs, the scanning electrode Y becomes relatively negative in comparison with the sustain electrode Z, that is, the polarity thereof reverses, thereby decreasing wall electric charges which are produced in Set-up.

In an address period APD, scan pulse SP is applied to the scanning electrode Y and data pulse CDP is applied to the address electrode X at the same time, thereby causing an address discharge. This address discharge produces a wall electric charge, and then the wall electric charge is sustained while the other discharge cells are addressed.

By applying triggering pulse TP to the scanning electrode Y in the initial point of sustain period SPD, sustain discharge is caused in discharge cells where wall electric charges are fully formed in the address period APD. Then, sustain pulses SUSPz and SUSPy are applied to the sustain electrode Z and the scanning electrode Y alternately, thereby sustaining the sustain discharge in sustain period SPD.

In an erasing period EPD following such sustain period SPD, by applying an erasing pulse to the sustain electrode Z, the sustained discharge is stopped. The erasing pulse EP is a lamp waveform having small size of luminescence, or has narrow pulse width such as about 1 us. As a result of short erase discharge due to such erase pulse EP, electric charges are erased, thereby stopping the discharge.

However, because the reset discharge caused in reset periods of all sub-fields in one frame has no connection with cell selection, there is a disadvantage of contrast reduction To compensate such disadvantage resulting from the formation where all sub-fields include reset period, Japanese Laid-Open Patent Publication No. 2000-242224 discloses a technology that one field period has sub-fields SF1, . . . , SF8 each of which has reset period, address period, and sustain period, and a part of reset operation in reset periods of SF2, . . . , SF8 excluding SF1 is simultaneously made with the sustain operation of sustain period of previous sub-field, thereby decreasing reset time and discharge.

But, because reset period is not completely erased in this related art, there is a disadvantage that contrast is not improved greatly.

SUMMARY OF THE INVENTION

Accordingly, an object of the present invention is to substantially obviate one or more of the problems caused by limitations and disadvantages of the related art.

It is another object of the present invention to provide method of driving PDP where quantity of luminescence non-luminescent period is minimized by applying a reset pulse to each cells in one frame, and in addition, ON/OFF states of cell are converted into each other by changing wall electric charge distribution in cell using discharge between a scanning electrode Y and an address electrode X or between a sustain electrode Z and the address electrode X in an address period.

In a method of driving PDP according to the present invention, the method of driving PDP comprising a plurality of discharge cells including a plurality of scanning electrodes, a plurality of sustain electrodes, and a plurality of address electrodes comprises a step of forming a frame having a plurality of sub-fields; a step of causing a reset discharge in only first sub-fields of respective the plurality of discharge cells; a step of deciding ON/OFF state of discharge cells in current sub-field in accordance with ON/OFF state of discharge cells in previous sub-field; and a step of converting the discharge cell into any one of ON/OFF wall electric charges in accordance with ON/OFF state of the decided discharge cell.

Further, in the frame including the plurality of sub-fields, the first sub-field is divided into a reset period, an address period, and a sustain period, the other sub-fields are respectively divided into address period and sustain period, and the step of converting the discharge cell into any one wall electric charge of ON/OFF is achieved by controlling voltage applied to the plurality of scanning electrodes, a plurality of sustain electrodes, and a plurality of address electrodes in accordance with ON/OFF state of a previous discharge cell in address period of a current sub-field.

In addition, the step of converting the ON state discharge cell in the previous sub-field into OFF state wall electric charge in address period of the current sub-field comprises a step of applying a scan pulse to the scanning electrode in the address period; a step of applying a sustain pulse having higher DC voltage than positive DC voltage applied in Set-down of a reset pulse to the sustain electrode, and a step of applying data pulse of negative polarity to the address electrode.

And, the step of sustaining the ON state discharge cell in the previous sub-field to ON state wall electric charge in address period of the current sub-field comprises a step of applying a scan pulse to the scanning electrode in the address period; a step of applying a sustain pulse having higher DC voltage than positive DC voltage applied in Set-down of a reset pulse to the sustain electrode, and a step of applying data pulse having 0 voltage to the address electrode.

Furthermore, the step of converting the OFF state discharge cell in the previous sub-field into ON state wall electric charge in address period of the current sub-field comprises a step of applying a scan pulse to the scanning electrode in the address period; a step of applying a sustain pulse having DC voltage equivalent to positive DC voltage applied in Set-down of a reset pulse to the sustain electrode, and a step of applying data pulse of positive polarity to the address electrode.

Also, the step of sustaining the OFF state discharge cell in the previous sub-field to OFF state wall electric charge in address period of the current sub-field comprises a step of applying a scan pulse to the scanning electrode in the address period; a step of applying a sustain pulse having DC voltage equivalent to positive DC voltage applied in Set-down of a reset pulse to the sustain electrode, and a step of applying data pulse having 0 voltage to the address electrode.

Further, in a method of driving PDP according to the present invention, the method of driving PDP where one frame screen is realized by making a selective combination X numbers of sub-fields SF1, SF2, SF3, . . . , SFX, sustain period of each of which is allowed at the rate of $2^0:2^1:2^2 2^3: \ldots :2^{X-1}$ so as to display multi contrast image on PDP, in the unit of cell for a certain period, wherein only one reset discharge in only first sub-field SF1 of respective the plurality of discharge cells is caused and the discharge cell in current sub-field is converted into any one wall electric charge of ON/OFF in accordance with ON/OFF state of the discharge cell in previous sub-field.

Additional advantage, objects, and features of the invention will be set forth in part in the description which follows and in part will become apparent to those having ordinary skill in the art upon examination of the following or may be learned from practice of the invention. The objects and advantages of the invention may be realized and attained as particularly pointed out in the appended claims.

BRIEF DESCRIPTION OF THE DRAWINGS

The present invention will he described in detail with reference to the following drawings in which like reference numerals refer to like elements wherein.

DETAILED DESCRIPTION OF PREFERRED EMBODIMENTS

Hereinafter, the preferred embodiment of the present invention will be described in detail with reference to FIGS. 5 through 9*b*.

Figure 1:
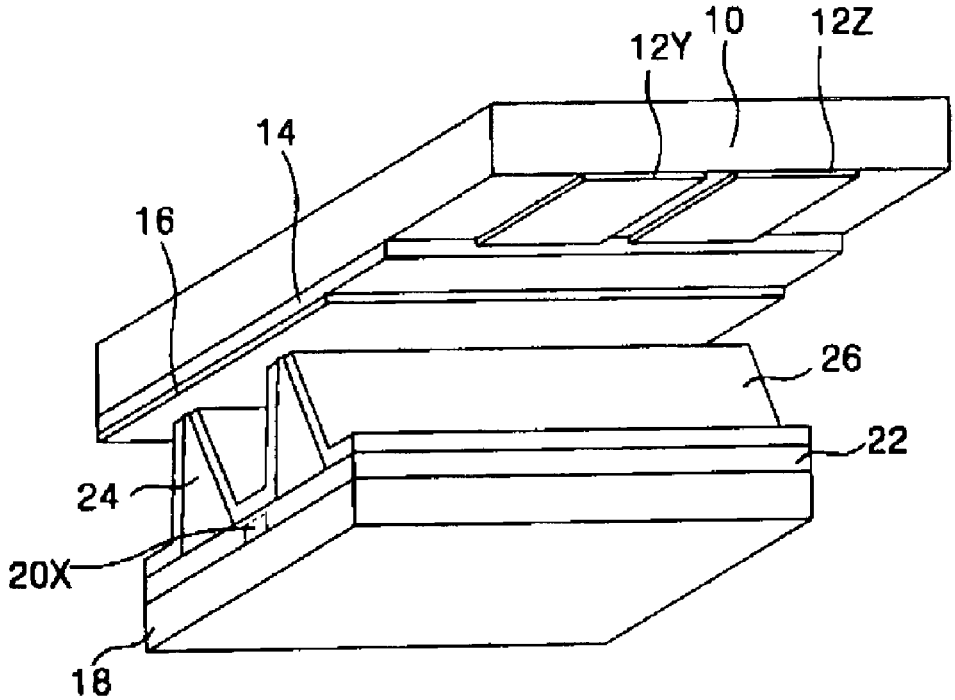
FIG. 1 (PRIOR ART)
FIG. 1 is a perspective view showing a conventional AC normal radiation PDP.
Figure 2:
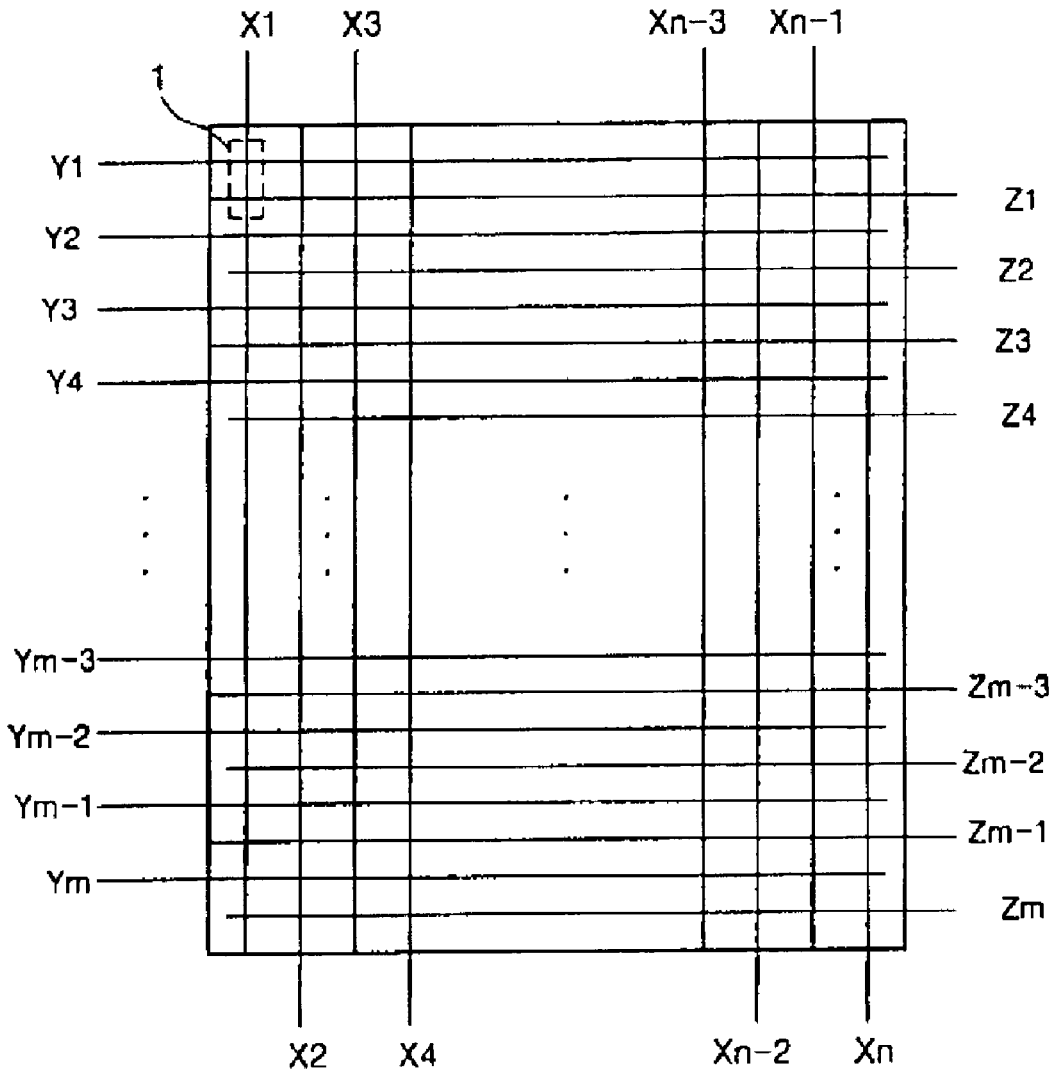
FIG. 2 (PRIOR ART)
FIG. 2 is a diagram showing electrode arrangements of PDP shown in FIG. 1.
Figure 3:
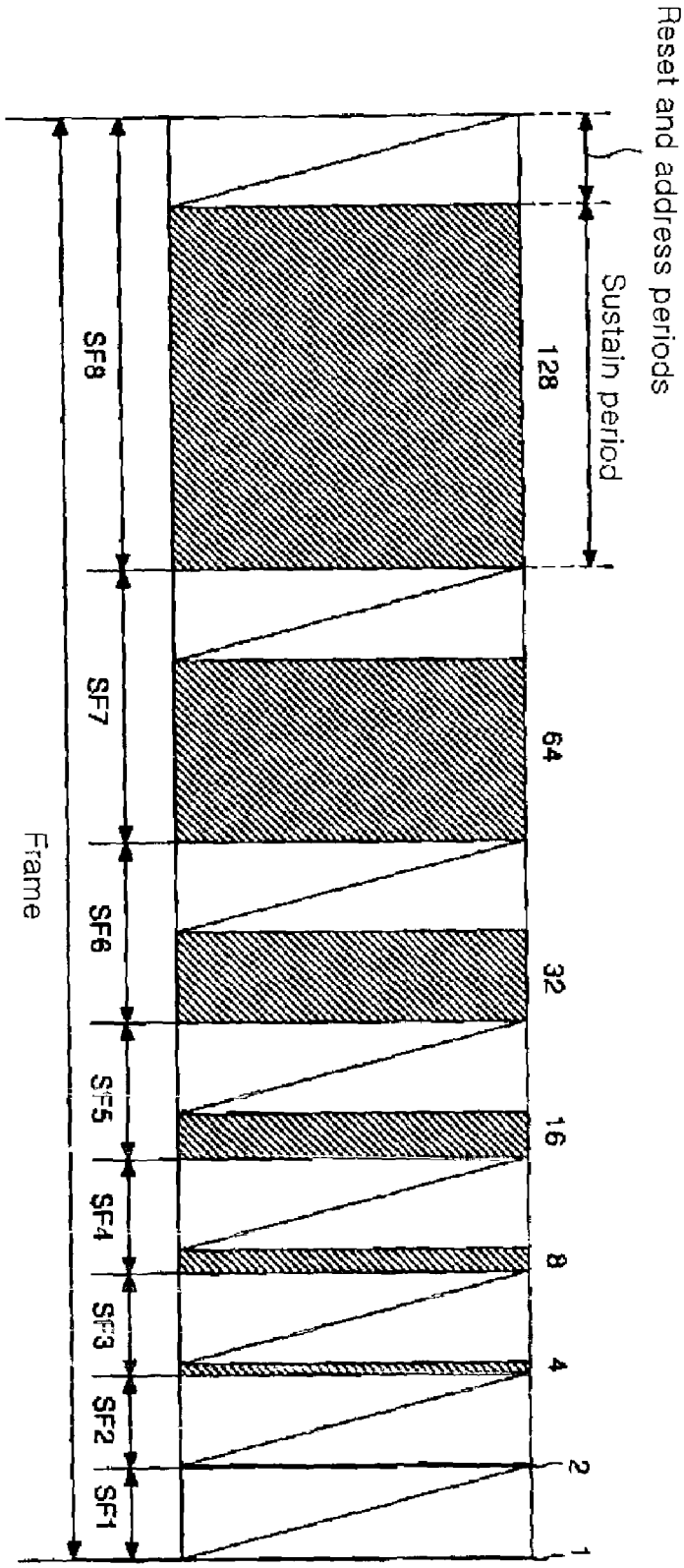
FIG. 3 (PRIOR ART)
FIG. 3 is a diagram showing a frame formation according to conventional sub-field driving method.
Figure 4:
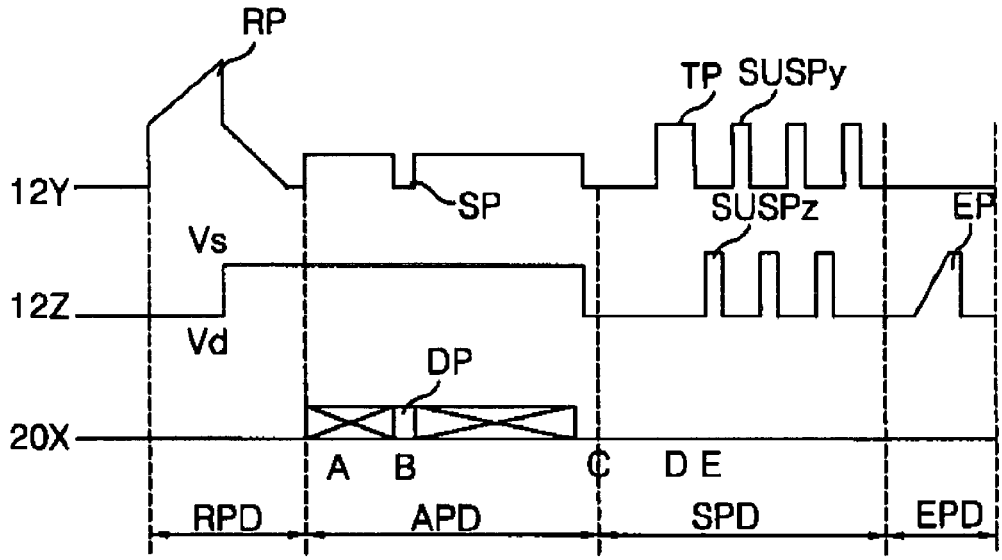
FIG. 4 (PRIOR ART)
FIG. 4 is a diagram showing a driving waveform for driving the PDP shown in FIG. 1 in a frame.
Figure 5:
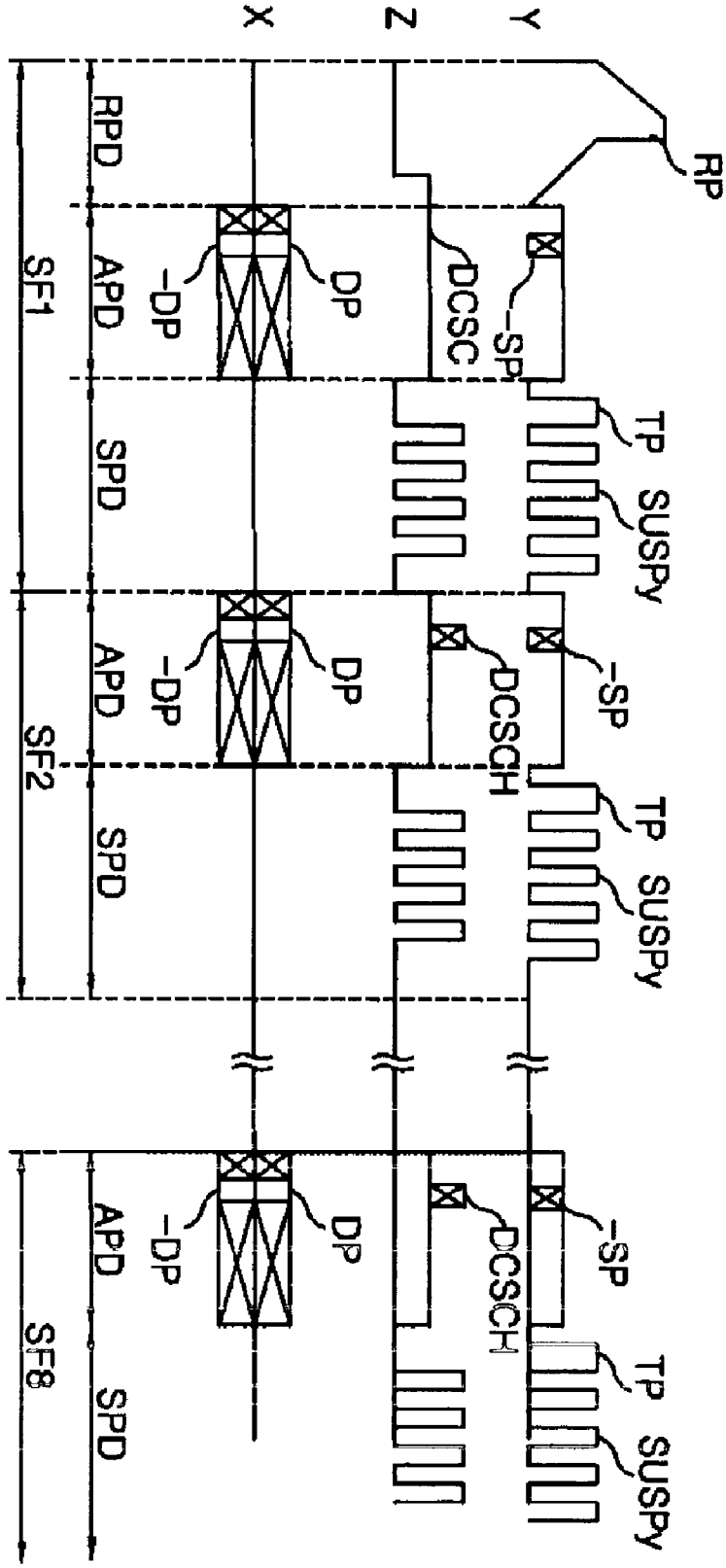
FIG. 5 is a diagram showing a driving waveform according to the method of driving PDP in accordance with the preferred embodiment of the present invention.

FIG. 5 is a diagram showing a driving waveform according to the method of driving PDP in accordance with the preferred embodiment of the present invention.

As shown in FIG. 5, a method of driving PDP in accordance with the present invention includes applying a reset pulse to only a first sub-field in a frame.

First, a reset pulse RP is applied to a scanning electrode Y in a reset period RPD of a first sub-field SF1. The reset pulse RP has a lamp waveform where voltage increase in Set-up and voltage decrease in Set-down. Because of reset discharge caused in Set-up, wall electric charges are formed at an upper dielectric layer 14. Then, decreasing voltage in Set-down erase unnecessary charge particles partially, so that discharge without fault discharge. To decrease the wall electric charge, a positive DC voltage Vs is applied to the sustain electrode Z in Set-down of the reset pulse RP.

Because the reset pulse RP is applied in gradual decrease against this positive DC voltage Vs, the scanning electrode Y becomes relatively negative in comparison with the sustain electrode Z, that is, the polarity thereof reverses, thereby decreasing wall electric charges which are produced in Set-up.

Therefore, the reset discharge is caused for the whole reset period (Set-up & Set-down), the polarity reversion is caused in the reset period. And, negative wall electric charges are formed at the scanning electrode Y, positive wall electric charges are formed at the sustain electrode Z, and positive wall electric charges are formed at the address electrode X in the Set-up period where the voltage of the scanning electrode Y increases. And, a portion of negative wall electric charges formed on the scanning electrode Y are erased, positive wall electric charges formed on the sustain electrode Z are converted into negative wall electric charges, and a portion of positive wall electric charges formed on the address electrode X are erased in the Set-down period where the voltage of the scanning electrode Y decreases. Thus, after the reset period, positive wall electric charges are formed at the address electrode X, and negative wall electric charges are formed at the scanning electrode Y and the sustain electrode Z.

In an address period APD, scan pulse SP is applied to the scanning electrode Y and data pulse DP is applied to the address electrode X at the same time, thereby causing an address discharge. This address discharge produces a wall electric charge, and then the wall electric charge is sustained while the other discharge cells are addressed. At this time, data pulse DP applied to the address electrode X is characterized by selecting any one of positive and negative data pulses and applying it.

In this point, the data pulse DP selection is changed with response to the ON/OFF states of cell. Thus, when positive wall electric charges are formed at the address electrode X and negative wall electric charges are formed at the scanning electrode Y and the sustain electrode Z through the Set-down of reset period of the first sub-field, state of the cell becomes OFF state.

By applying triggering pulse TP to the scanning electrode Y in the initial point of sustain period SPD, sustain discharge is caused in discharge cells where wall electric charges are fully formed in the address period APD. Then, sustain pulses SUSPz and SUSPy are, applied to the sustain electrode Z and the scanning electrode Y alternately, thereby sustaining the sustain discharge in sustain period SPD.

In a second sub-field SF2, there is no reset period, and begin with address period APD. In the address period APD, scan pulse SP is applied to the scanning electrode Y and data pulse DP is applied to the address electrode X at the same time, thereby causing an address discharge. This address discharge produces a wall electric charge, and then the wall electric charge is sustained while the other discharge cells are addressed.

At this time, data pulse DP applied to the address electrode X is characterized by selecting any one of positive and negative data pulses and applying it, and the data pulse DP selection is changed with response to the ON/OFF states of cell.

Further, unnecessary charge particles are partially erased by decreasing voltage in Set-down of the first sub-field SF1. Thus, so as to decrease the wall electric charges to the state for next address discharge without fault discharge, a positive DC voltage Vs is applied to the sustain electrode Z in Set-down of the reset pulse RP but a positive DC voltage Vs is applied to the sustain electrode Z in the second sub-field SF2 with the beginning of the address period APD.

In applying a scan pulse SP to the scanning electrode Y and applying data pulse DP to the address electrode X at the same time, an address discharge is caused by applying higher DC voltage Vsh more than positive DC voltage Vs to the sustain electrode.

That is, when higher DC voltage Vsh more that positive DC voltage Vs is applied to the sustain electrode, an address discharge is caused by applying negative data pulse DP to the address electrode X.

Thereby, ON state cell in sustain period of previous sub-field is changed into OFF state cell without reset period. And, this will now be described in detail with reference to FIGS. 7*a* and 7*b*.

By applying triggering pulse TP to the scanning electrode Y in the initial point of sustain period SPD, sustain discharge is caused in discharge cells where wall electric charges are fully formed in the address period APD. Then, sustain pulses SUSPz and SUSPy are applied to the sustain electrode Z and the scanning electrode Y alternately, thereby sustaining the sustain discharge in sustain period SPD.

In a third through an eight sub-fields SF3–SF8, discharge is caused in the same method of driving in the second sub-field.

Figure 6A:
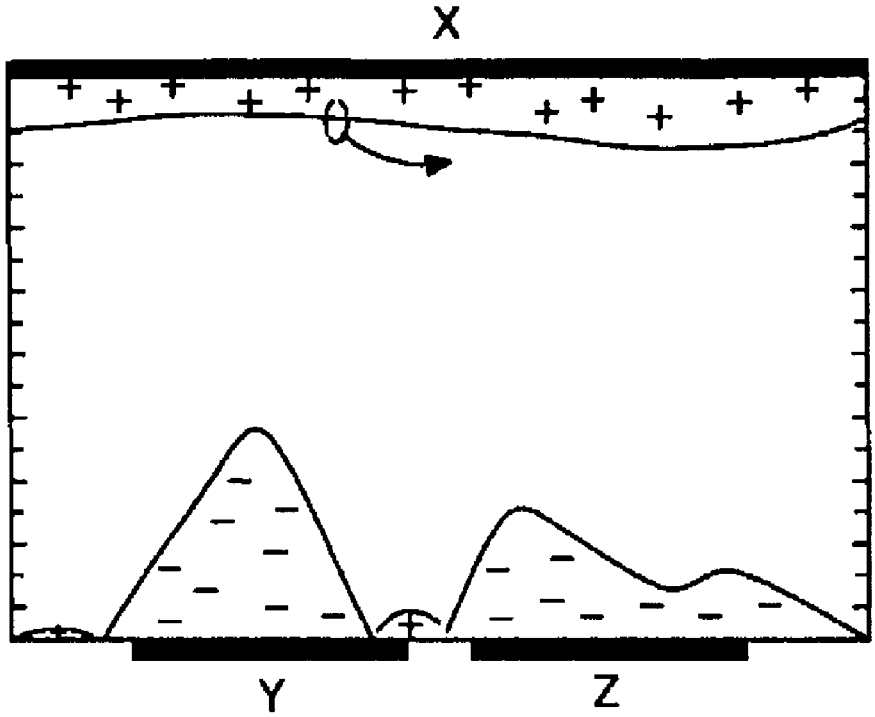
FIGS. 6*a* and 6*b* are diagrams showing wall electric charge distribution of OFF and ON states cells in all sub-fields in a frame.
Figure 6B:
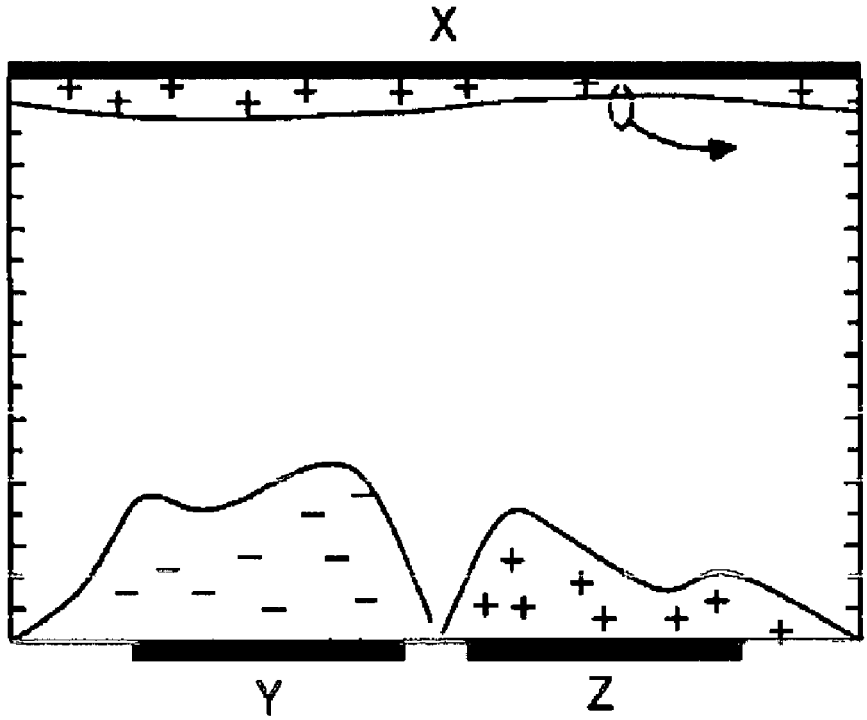

FIGS. 6*a* and 6*b* are diagrams showing wall electric charge distribution of OFF and ON states cells in all sub-fields in a frame.

As shown in FIGS. 6*a* and 6*b*, FIG. 6*a* is a diagram showing wall electric charge distribution of OFF state cell reset pulse. Namely, positive wall electric charges are formed at the address electrode X, and negative wall electric charges are formed at the upper dielectric layer over surfaces of the scanning electrode Y and the sustain electrode Z.

In this point, because negative wall electric charges are formed at the upper dielectric layer over surfaces of scanning electrode and sustain electrode, though a sustain voltage is applied, there is no sustain discharge.

Here, the sustain voltage is a voltage which is applied alternately to the scanning electrode Y and the sustain electrode Z in the sustain period.

FIG. 6*b* is a diagram showing wall electric charge distribution of ON state cell where positive wall electric charges are formed at the address electrode X and the sustain electrode Z and negative wall electric charges are formed at the scanning electrode Y.

That is, in the ON state cell, the scanning electrode Y has an opposite polarity to the sustain electrode Z for the sustain period.

In wall electric charge distribution of ON state cell, because polarities of wall electric charges accumulated at the dielectric layer over surfaces of the scanning electrode Y and the sustain electrode Z are different from each other, sustain discharge continue to be caused due to the sustain voltage. During the sustain period SPD where sustain discharge continue to be caused, wall electric charge are accumulated alternately in the scanning electrode Y and the sustain electrode Z, if the last pulse of sustain pulse comes to the scanning electrode Y, there is wall electric charge distribution equivalent to the state in FIG. 6*b*.

FIGS. 7*a* through 9*b* are diagrams showing wall electric charge distribution in ON/OFF state conversion of cell without reset period in address period by using wall electric charge distribution produced in sustain period of previous sub-field through driving waveforms shown in FIG. 5.

Figure 7A:
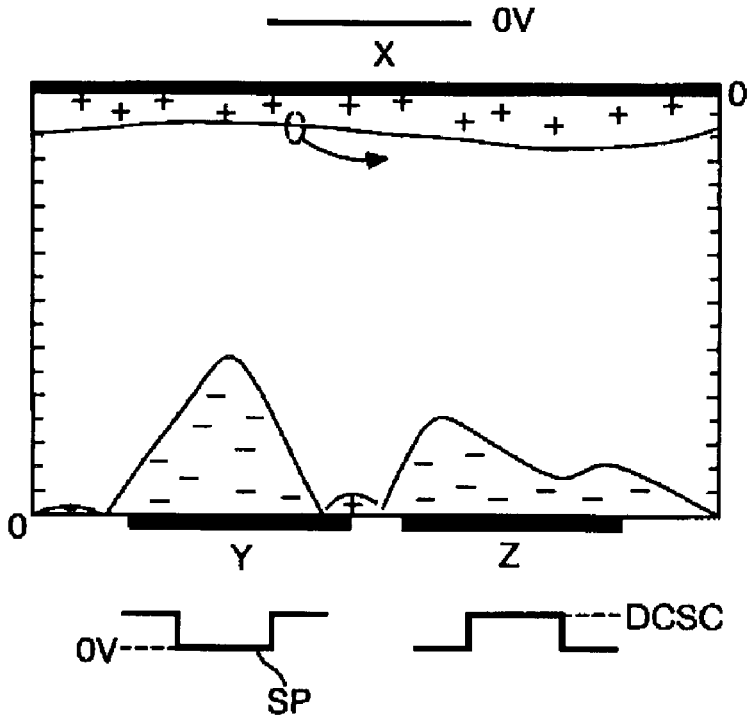
FIGS. 7*a* and 7*b* are diagrams illustrating a conversion mechanism from ON state cell in sustain period of previous sub-field into OFF state cell in address period without reset period.
Figure 7B:
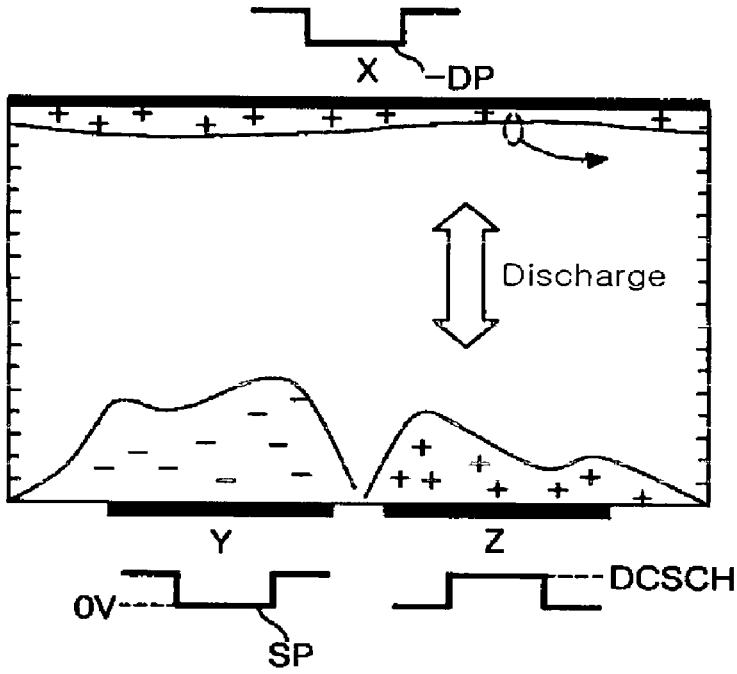

FIGS. 7*a* and 7*b* are diagrams illustrating a conversion mechanism from ON state cell in sustain period of previous sub-field into OFF state cell in address period without reset period.

As shown in FIGS. 7*a* and 7*b*, FIG. 7*a* is a diagram showing that negative scan pulse is applied to the scanning electrode Y and positive enhanced DC voltage Vsh is applied to the sustain electrode Z in ON state cell shown in FIG. 6*b*.

At this time, negative data pulse DP is applied to the address electrode X to convert ON state cell into OFF state, thereby causing a discharge between the sustain electrode Z and the address electrode X.

In this case, voltage between the scanning electrode Y and the sustain electrode Z is not over the voltage for address electrode X and the sustain electrode Z exceeds the voltage for beginning to cause discharge so as to cause discharge between the address electrode X and the sustain electrode Z.

Due to such induced discharge, as shown in FIG. 7*b*, wall electric charge distribution is equivalent to the state of cell which are sustained OFF state shown in FIG. 6*a*. And then, there is no discharge in sustain period SPD.

Figure 8A:
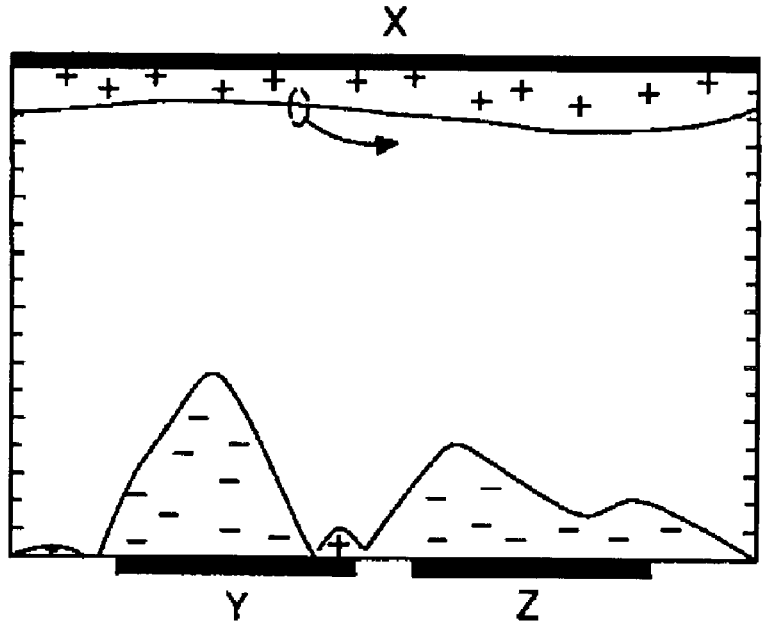
FIGS. 8*a* and 8*b* are diagrams illustrating a conversion mechanism from OFF state cell in sustain period of previous sub-field into ON state cell in address period without reset period.
Figure 8B:
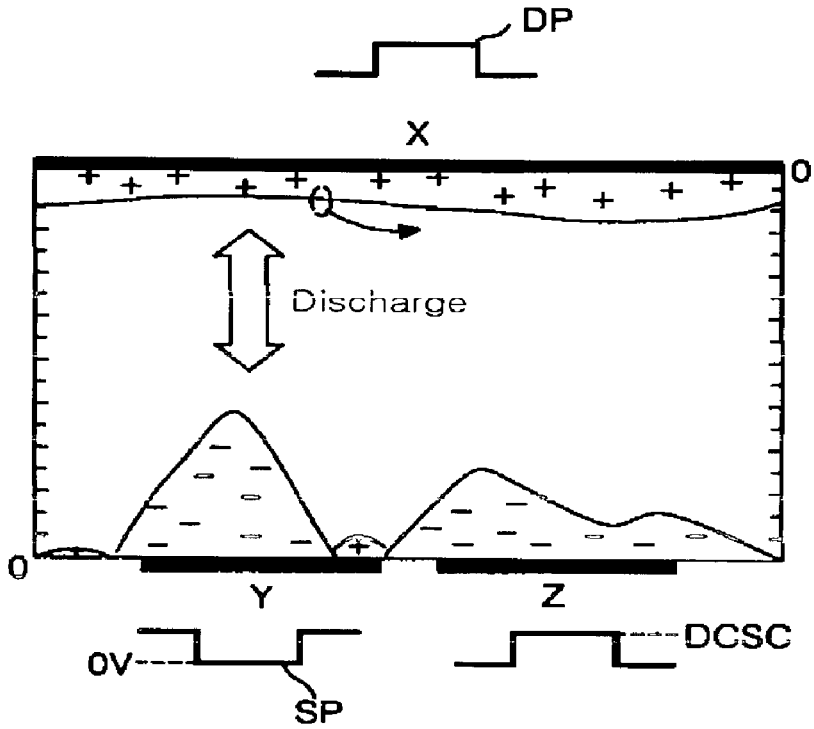

FIGS. 8*a* and 8*b* are diagrams illustrating a conversion mechanism from OFF state cell in sustain period of previous sub-field into ON state cell in address period without reset period.

As shown in FIGS. 8*a* and 8*b*, FIG. 8*a* is a diagram showing that negative scan pulse is applied to the scanning electrode Y and positive DC voltage Vs is applied to the sustain electrode Z in OFF state cell shown in FIG. 6*b*. At this time, positive data pulse DP is applied to the address electrode X to convert OFF state cell into ON state.

Thereby, discharge is caused between the scanning electrode Y and the address electrode X, so that positive wall electric charge different from the polarity of the sustain electrode Z are accumulated in the address electrode X.

In this case, wall electric charges, polarities of which are different from each other, are formed at the upper dielectric layer over the scanning electrode Y and the sustain electrode Z, respectively, so that discharge is caused in sustain period. And then, cell comes to the state of FIG. 8*b*.

Figure 9A:
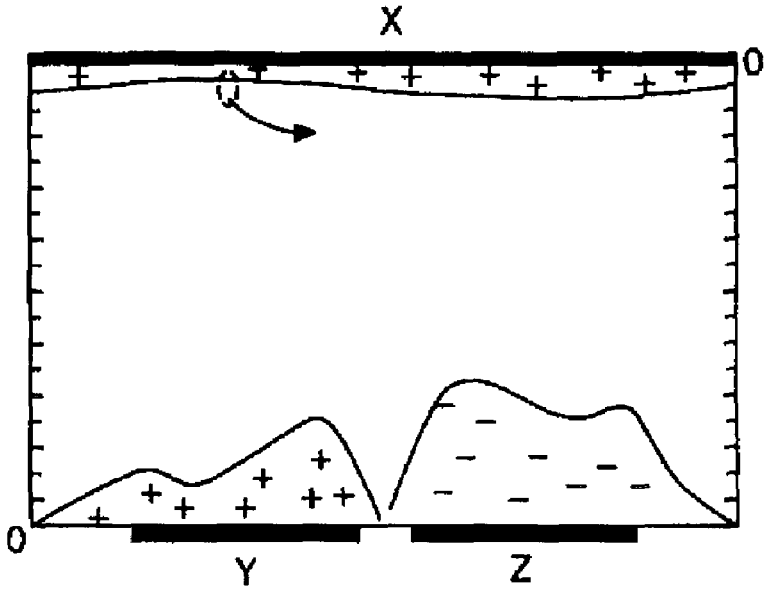
FIGS. 9*a* and 9*b* are diagram illustrating a method of sustaining distribution of wall electric charge produced in sustain period of previous sub-field without a change.
Figure 9B:
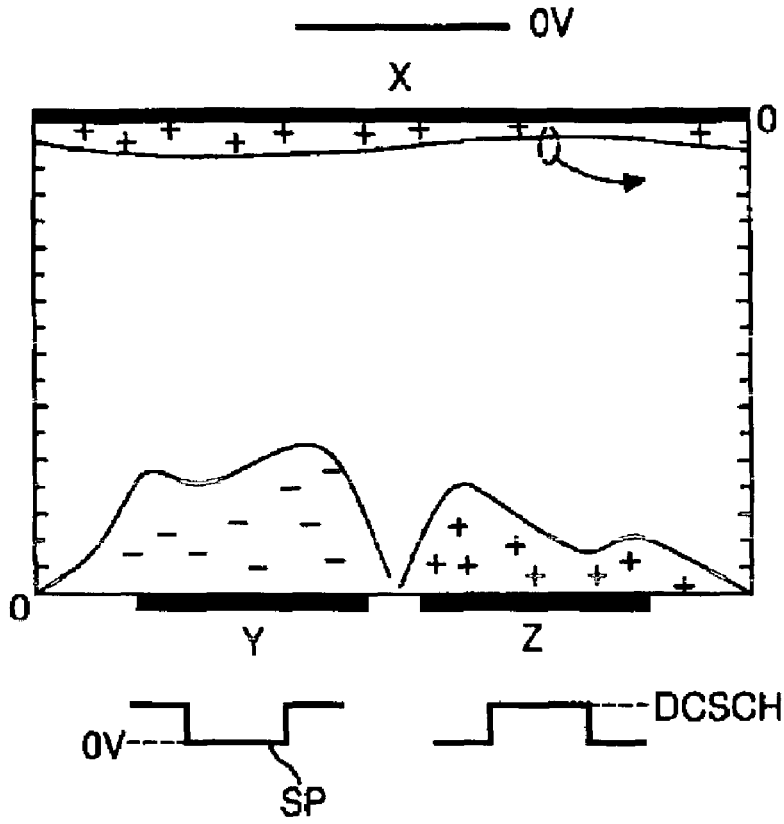

FIGS. 9*a* and 9*b* are diagram illustrating a method of sustaining distribution of wall electric charge produced in sustain period of previous sub-field without a change.

As shown in FIG. 9*a*, it is shown that wall electric charge state in the case that ON state cell formed in reset period of previous sub-field remains cell having ON state wall electric charge distribution without a change, and voltage applied to each electrodes.

Namely, it is shown that negative scan pulse is applied to the scanning electrode Y and positive enhanced DC voltage Vsh is applied to the sustain electrode Z. The moment cell is selected, as described above, if voltage is not applied to the address electrode X, discharge is not caused between the address electrode X and the sustain electrode Z, so that the state of wall electric charge is sustained. Thus, ON state cell in previous sub-field remains ON state wall electric charge just as it is.

However, voltages of the scanning electrode Y and the sustain electrode Z have to be controlled in order to prevent discharge in non-selected cell.

As shown in FIG. 9*b,* it is shown that wall electric charge state in the case that OFF state cell formed in reset period of previous sub-field remains cell having OFF state voltage applied to each electrodes.

Namely, it is shown that negative scan pulse is applied to the scanning electrode Y and positive DC voltage Vs is applied to the sustain electrode Z. The moment cell is selected, as described above, if voltage is not applied to the address electrode X, discharge is not caused between the address electrode X and the scanning electrode Y.

But, it is condition of voltage level that voltage between the scanning electrode Y and the sustain electrode Z remains a level where no discharge is caused between the scanning electrode Y and the sustain electrode Z, and voltages of the scanning electrode Y and the sustain electrode Z remains a level where no discharge is caused in non-selected cell.

As described above, it is provided the method of driving PDP according to the present invention that wall electric charge distribution in cell is changed by causing a discharge with minimizing quantity of luminescence in non-luminescent display period by causing only one reset discharge in each cell in a frame and changing the polarity of data pulse applied in address period of sub-field with reference to the state of previous sub-field at the same time, thereby reset period after the second sub-field is unnecessary so that contrast ratio is improved.

The foregoing embodiments are merely exemplary and are not to be construed as limiting the present invention. The present teaching can be readily applied to other methods of driving PDP. The description of the present invention is intended to be illustrative, and not to limit the scope of the claims. Many alternatives, modifications, and variations will be apparent to those skilled in the art.

What is claimed is:

1. A method of driving a plasma display panel comprising a plurality of discharge cells including a plurality of scanning electrodes, a plurality of sustain electrodes, and a plurality of address electrodes, comprising:

a step of forming a frame having a plurality of sub-fields;

a step of applying a reset pulse to scanning electrode in only first sub-fields, to form wall electric charge in the discharge cells using a lamp waveform to increase voltage in Set-up of the reset pulse, and to partially eliminate unnecessary charged particles using a lamp waveform to decrease voltage in Set-down of the reset pulse while applying a positive DC voltage to the sustain electrode.

2. The method according to claim 1, wherein, in the frame including the plurality of sub-fields, the first sub-field is divided into a reset period, an address period, and a sustain period, and the other sub-fields are divided into address period and sustain period.

3. The method according to claim 1, further comprising:

a step of deciding ON/OFF state of discharge cells in current sub-field in accordance with ON/OFF state of discharge cells in previous sub-field; and a step of converting the discharge cell into any one of ON/OFF wall electric charges in accordance with ON/OFF state of the decided discharge cell.

4. The method according to claim 3, wherein a step of converting an ON state discharge cell in the previous sub-field into an OFF state wall electric charge in address period of the current sub-field comprises a step of applying a scan pulse to the scanning electrode in the address period;

a step of applying a sustain pulse having higher DC voltage than positive DC voltage applied in Set-down of a reset pulse to the sustain electrode; and a step of applying data pulse of negative polarity to the address electrode.

5. The method according to claim 3, further comprising a step of sustaining an ON state discharge cell in the previous sub-field to an ON state wall electric charge in address period of the current sub-field by a step of applying a scan pulse to the scanning electrode in the address period;

a step of applying a sustain pulse having higher DC voltage than positive DC voltage applied in Set-down of a reset pulse to the sustain electrode; and a step of applying data pulse having 0 voltage to the address electrode.

6. The method according to claim 3, wherein a step of converting an OFF state discharge cell in the previous sub-field into an ON state wall electric charge in address period of the current sub-field comprises a step of applying a scan pulse to the scanning electrode in the address period;

a step of applying a sustain pulse having DC voltage equivalent to positive DC voltage applied in Set-down of a reset pulse to the sustain electrode; and a step of applying data pulse of positive polarity to the address electrode.

7. The method according to claim 3, further comprising the step of sustaining the an OFF state discharge cell in the previous sub-field to an OFF state wall electric charge in address period of the current sub-field by a step of applying a scan pulse to the scanning electrode in the address period;

a step of applying a sustain pulse having DC voltage equivalent to positive DC voltage applied in Set-down of a reset pulse to the sustain electrode; and a step of applying data pulse having 0 voltage to the address electrode.

8. The method according to claim 1, wherein the step of converting the discharge cell into any one wall electric charge of ON/OFF is achieved by controlling voltage applied to the plurality of scanning electrodes, the plurality of sustain electrodes, and the plurality of address electrodes in accordance with ON/OFF state of a previous discharge cell in address period of a current sub-field.

9. A method of driving a plasma display panel where one frame screen is realized by making a selective combination X numbers of sub-fields SF1, SF2, SF3, . . . , SFX, sustain period of each of which is allowed at the rate of $2^0:2^1:2^2:2^3: \ldots :2^{X-1}$ so as to display multi contrast image on PDP, in the unit of cell for a certain period, wherein only one reset discharge in only first sub-field SF1 of a respective plurality of discharge cells is caused to occur and the discharge cell in current sub-field is converted into any one wall electric charge of ON/OFF in accordance with ON/OFF state of the discharge cell in previous sub-field.

10. The method according to claim 9, wherein, in the frame including the plurality of sub-fields, the first sub-field is divided into a reset period, an address period, and a sustain period, and the other sub-fields are divided into address period and sustain period.

11. The method according to claim 9, wherein the discharge cell in current sub-field is converted into any one wall electric charge of ON/OFF by controlling voltage applied to the plurality of scanning electrodes, the plurality of sustain electrodes, and the plurality of address electrodes in accordance with ON/OFF state of a previous discharge cell in address period of a current sub-field.

12. The method according to claim 11, wherein the an ON state discharge cell in the previous sub-field is converted into an OFF state wall electric charge in address period of the current sub-field by a step of applying a scan pulse to the scanning electrode in the address period;

a step of applying a sustain pulse having higher DC voltage than positive DC voltage applied in Set-down of a reset pulse to the sustain electrode; and a step of applying data pulse of negative polarity to the address electrode.

13. The method according to claim 11, further comprising sustaining an ON state discharge cell in a previous sub-field to an ON state wall electric charge in address period of the current sub-field by a step of applying a scan pulse to the scanning electrode in the address period;

a step of applying a sustain pulse having higher DC voltage than positive DC voltage applied in Set-down of a reset pulse to the sustain electrode; and a step of applying data pulse having 0 voltage to the address electrode.

14. The method according to claim 11, wherein a step of converting an OFF state discharge cell in the previous sub-field into an ON state wall electric charge in an address period of the current sub-field comprises a step of applying a scan pulse to the scanning electrode in the address period;

a step of applying a sustain pulse having DC voltage equivalent to positive DC voltage applied in Set-down of a reset pulse to the sustain electrode; and a step of applying data pulse of positive polarity to the address electrode.

15. The method according to claim 11, further comprising sustaining an OFF state discharge cell in a previous sub-field to OFF state wall electric charge in address period of the current sub-field by a step of applying a scan pulse to the scanning electrode in the address period;

a step of applying a sustain pulse having DC voltage equivalent to positive DC voltage applied in Set-down of a reset pulse to the sustain electrode; and a step of applying data pulse having 0 voltage to the address electrode.

* * * * *